US008907570B2

(12) United States Patent
Kwag et al.

(10) Patent No.: US 8,907,570 B2
(45) Date of Patent: Dec. 9, 2014

(54) SYSTEM AND METHOD FOR CONTROLLING LIGHTING

(75) Inventors: Heui Sam Kwag, Suwon-si (KR); Chang Seob Kim, Seoul (KR); Jung Hwan Park, Busan (KR); Ho Chan Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 501 days.

(21) Appl. No.: 13/044,664

(22) Filed: Mar. 10, 2011

(65) Prior Publication Data

US 2011/0221348 A1 Sep. 15, 2011

(30) Foreign Application Priority Data

Mar. 10, 2010 (KR) ..... 10-2010-0021088

(51) Int. Cl.
*H05B 37/04* (2006.01)
*H05B 37/02* (2006.01)

(52) U.S. Cl.
CPC ..... *H05B 37/0272* (2013.01); *H05B 37/029* (2013.01)
USPC ..... 315/130; 315/152; 315/294; 315/312

(58) Field of Classification Search
USPC ..... 315/130, 149–159, 291, 293, 294, 295, 315/307, 312
See application file for complete search history.

(56) References Cited

U.S. PATENT DOCUMENTS

| | | | | |
|---|---|---|---|---|
| 5,838,116 | A * | 11/1998 | Katyl et al. | 315/307 |
| 6,969,954 | B2 * | 11/2005 | Lys | 315/155 |
| 8,049,434 | B2 * | 11/2011 | Crouse et al. | 315/291 |
| 8,121,109 | B2 * | 2/2012 | Sibileau | 370/349 |
| 2002/0093296 | A1 * | 7/2002 | Belliveau | 315/294 |
| 2003/0020595 | A1 * | 1/2003 | Wacyk | 340/3.5 |
| 2006/0044152 | A1 * | 3/2006 | Wang | 340/825 |
| 2007/0273307 | A1 | 11/2007 | Westrick et al. | |
| 2008/0183337 | A1 | 7/2008 | Szabados | |
| 2009/0273296 | A1 * | 11/2009 | Veskovic et al. | 315/246 |
| 2011/0140611 | A1 * | 6/2011 | Elek et al. | 315/130 |
| 2013/0093333 | A1 * | 4/2013 | Smith | 315/154 |

FOREIGN PATENT DOCUMENTS

| | | | |
|---|---|---|---|
| JP | 11-111469 | A | 4/1999 |
| JP | 11-135268 | A | 5/1999 |
| JP | 2000-294388 | A | 10/2000 |
| JP | 2008-135228 | A | 6/2008 |
| KR | 1020020012456 | A | 2/2002 |
| KR | 200422808 | | 7/2006 |
| KR | 10-2007-0040774 | A | 4/2007 |
| KR | 100724795 | B1 | 5/2007 |
| KR | 10-2009-0055361 | A | 6/2009 |

OTHER PUBLICATIONS

Communication dated Apr. 19, 2011 issued by the Korean Patent Office in counterpart Korean Application No. 20090148661.

* cited by examiner

*Primary Examiner* — Tung X Le
(74) *Attorney, Agent, or Firm* — Sughrue Mion, PLLC

(57) ABSTRACT

Disclosed herein are a system and a method for controlling lighting. In the lighting control system, one or more lighting devices are installed in a separate area within a building and a remote controller generates a scheduling data by setting lighting scenes at each time and controls the lighting of the corresponding lighting device via a short range wireless communication. In addition, the remote controller transmits the scheduling data to a remote server through a gateway and when the remote controller is not normally operated, the remote server controls the lighting device according to the scheduling data through the gateway.

17 Claims, 5 Drawing Sheets

SYSTEM AND METHOD FOR CONTROLLING LIGHTING

CROSS REFERENCE TO RELATED APPLICATION

This application claims the benefit of Korean Patent Application No. 10-2010-0021088, filed on Mar. 10, 2010, entitled "System And Method For Controlling Lighting", which is hereby incorporated by reference in its entirety into this application.

BACKGROUND OF THE INVENTION

1. Technical Field

The present invention relates to a lighting control technology, and more particularly, to a technology that controls a corresponding lighting device via a short range wireless communication according to a predetermined schedule.

2. Description of the Related Art

A lighting device is a device that generates light and lights a dark place. As the lighting device, a fluorescent lamp, an incandescent lamp, or the like has been mainly utilized in the past. In the lighting device, each lamp is separately connected to switching units to be turned on/turned off or a plurality of lamps are connected to the switching units using one wire to be turned on/turned off.

Recently, research using a light emitting diode (LED) that is environmentally friendly while having low power consumption and high light efficiency has been developed and accordingly, research on a digital lighting control technology, for example, research on a dimming technology of controlling brightness of a lamp, a controlling technology of color temperature, and the like are being actively developed.

In addition, a lighting control technology that controls a lighting environment (for example, brightness, color temperature, and the like) according to an automatic control technology of lighting devices installed in the entire building and a use environment of users environment have been studied.

SUMMARY OF THE INVENTION

The present invention has been made in an effort to allow a remote controller to automatically control a lighting device at each corresponding time by setting lighting scenes to be implemented by the lighting device at each time through the remote controller.

The present invention is to allow a remote server to control the lighting devices according to the scheduling data through a gateway by transmitting a scheduling data set in the remote controller to the remote server, when the remote controller is not normally operated.

Another object according to the exemplary embodiments of the present invention may be understood by the following description and be carried out by members shown in the claims and the combination thereof.

An exemplary embodiment of the present invention provides a lighting control system including: one or more lighting devices that are installed in a separate area within a building; a remote controller that generates a scheduling data by setting lighting scenes implemented by the lighting devices at each time and then transmits the scheduling data to the outside, and controls the corresponding lighting device according to the scheduling data; a remote server that receives and stores the scheduling data; and a gateway that receives the scheduling data from the remote controller and transmits the scheduling data to the remote server.

The gateway confirms whether the remote controller is normally operated and when the remote controller is not normally operated, generates an abnormal alarm signal and transmits the abnormal alarm signal to the remote server.

When receiving the abnormal alarm signal, the remote server controls the lighting device according to the stored scheduling data through the gateway.

The remote controller generates a scheduling control signal according to the scheduling data and transmits the scheduling control signal to the lighting device, and the scheduling control signal includes unique identification information on the corresponding lighting device and at least one of on/off control signal, dimming level control signal, color temperature control signal of the corresponding lighting device.

The lighting device is installed in each classroom of a school, and the lighting scene includes a mathematics and inquiry learning mode, a creativity learning mode, a memory subject learning mode, a break time/lunch time mode, and a self-study mode according to the corresponding class schedule.

Another embodiment of the present invention provides a lighting control system, including: one or more lighting devices that are installed in a separate area within a building; and a remote controller that generates a scheduling data by setting lighting scenes implemented by the lighting devices at each time and controls the corresponding lighting device according to the scheduling data.

Still another embodiment of the present invention provides a lighting control method including: (A) allowing a remote controller to generate a scheduling data by setting lighting scenes at each time in each separate area within the corresponding building where lighting devices are installed according to a command input from the outside; and (B) allowing the remote controller to transmit the scheduling data to a remote server through a gateway.

The method further includes: after step (B), (C) allowing the gateway to confirm whether the remote controller is normally operated; (D) when the remote controller is not normally operated, allowing the gateway to generate an abnormal alarm signal and transmit the abnormal alarm signal to the remote server; and (E) allowing the remote server to control the lighting device according to the scheduling data through the gateway.

DESCRIPTION OF THE PREFERRED EMBODIMENTS

Hereinafter, exemplary embodiments of a lighting control system and a lighting control method according to the present invention will be described with reference to FIGS. 1 to 7. However, the invention may be embedded in many different forms and should not be construed as being limited to the embodiments set forth herein.

In the following description, when it is determined that the detailed description of the conventional technology related to the present invention would confuse the gist of the present invention, such description may be omitted. Terms used in the specification and claims herein are defined by considering the functions thereof in the present invention so that they may be varied according to a user's and an operator's intended use or practices. Therefore, the definitions thereof should be construed based on the contents throughout the specification.

In addition, the embodiments of the present invention carried out herein omit, if possible, the constitutions that have been previously provided in the constituents of respective system function in order to efficiently explain the technical constituents that constitute the present invention or that have been generally provided in the related arts to which the present invention pertains, and describe the present invention based on the function constitutions that should additionally be provided for the present invention. Those skilled in the art to which the present invention pertains may easily understand the function of the constituents that are used in the prior art, among the omitted constitutions and may also clearly understand the relationship between the omitted constitutions and the added constitutions.

Consequently, the technical idea of the present invention is determined by the claims and the exemplary embodiments herein are provided so that the technical idea of the present invention will be efficiently explained to those skilled in the art to which the present invention pertains.

Figure 1:
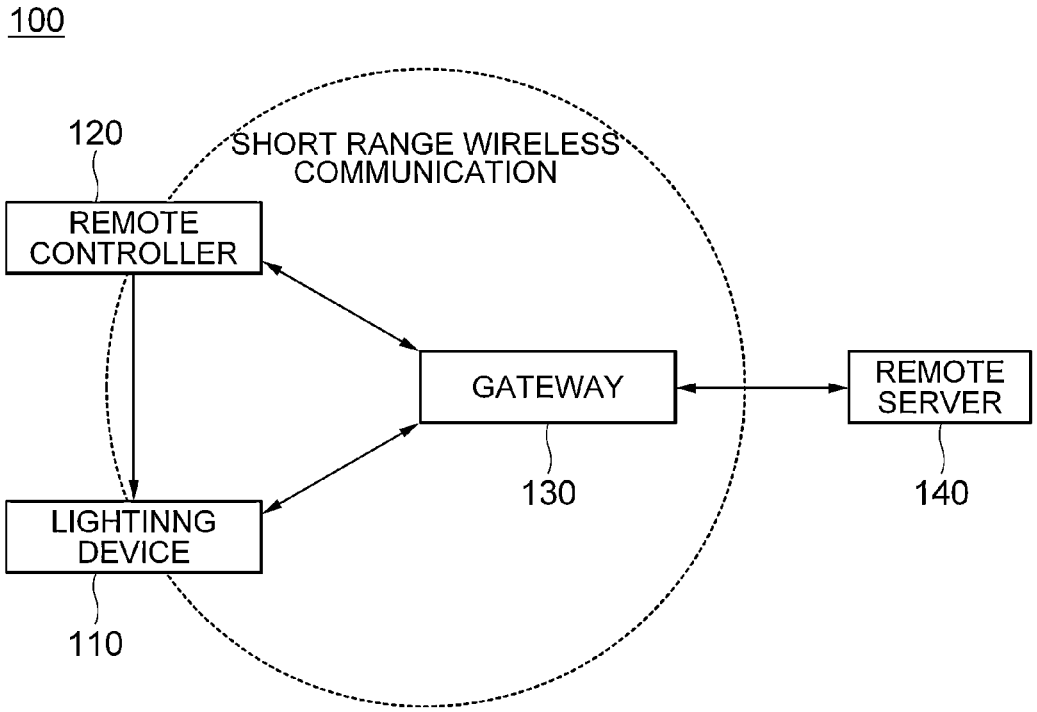
FIG. 1 is a diagram showing a constitution of a lighting control system according to an embodiment of the present invention.

FIG. 1 is a diagram showing a constitution of a lighting control system according to an embodiment of the present invention.

Referring to FIG. 1, the lighting control system 100 is configured to include a lighting device 110, a remote controller 120, a gateway 130, and a remote server 140.

A plurality of lighting devices 110 may be installed in a separate area within the corresponding building. For example, when the corresponding building is a school, the plurality of lighting devices 110 may be installed on the ceilings of each separate area, such as a classroom (a lecture room), an office (a teacher's room), a toilet, a hallway, and the like. At this time, the lighting devices 110 may be sorted per zone in each separate area and their lighting may be controlled per zone in the corresponding separate area.

The lighting device 110 is operated so as to implement lighting scenes scheduled at each time according to a control of the remote controller 120. Herein, the lighting scene represents the turn-on/turn-off, dimming level, and color temperature level of the corresponding lighting device. As the lighting device 110, a digital lighting device capable of controlling the dimming level and the color temperature, for example, a light emitting diode (LED), an organic light emitting diode (OLED), or the like can be used.

Further, when the remote controller 120 is not normally operated, the lighting device 110 is operated so as to implement the lighting scene scheduled at each time through the control of the gateway 130.

For example, when the power supply of the remote controller 120 is turned-off or the battery of the remote controller 120 is discharged so that when the remote controller 120 is not normally operated, the lighting device 110 is operated through the control of the gateway 130.

The remote controller 120 schedules and sets the lighting scenes at each time for each separate area of the corresponding building, and controls the lighting devices 110 according to the predetermined schedule. The remote controller 120 may be implemented to be in a portable remote controller form so that a manager may carry it or be fixedly installed on a wall surface of the building.

For example, when the lighting control system of the present invention is used at a school, the lighting device 110 is installed in each classroom and the remote controller 120 automatically controls the lighting device 110 installed in the corresponding classroom so that the lighting scene can be set according to the class schedule of each classroom and the preset lighting scene can be implemented for the corresponding class.

The lighting scene may be set to have optimal learning effects and energy reduction effects according to the corresponding class schedule. For example, the lighting scene may be sorted into a mathematics and inquiry learning mode, a creativity learning mode, a memory subject learning mode, a break time/lunch time mode, a self-study mode, and the like, according to the corresponding class schedule.

At this time, the lighting scene, such as the diming level, the color temperature, and the like, is set so that students can have optimal learning effects in the mathematics and inquiry learning mode, the creativity learning mode, the memory subject learning mode, the self-study mode, and the like according to each class schedule. The lighting scene, such as the diming level, the color temperature, and the like, may be set so that energy can be reduced during the break time/lunch time mode.

Herein, the remote controller 120 provides a user interface screen for setting a schedule so that a manager can schedule the lighting scene at each time. In this case, the manager can directly input the schedule into the remote controller 120.

The remote controller 120 performs a short range wireless communication with the lighting device 110. Herein, as the short range wireless communication, various communications, such as, Zigbee, Blue Tooth, Wireless Local Area Network (WLAN), Ultra Wide Band (UWB), Home RF, Infrared Data Association (IrDA), and the like, may be used. The remote controller 120 transmits a scheduling control signal to the lighting device 110 via the short range wireless communication. The scheduling control signal includes at least one of an on/off control signal, a dimming level control signal, and a color temperature control signal.

In addition, the remote controller 120 transmits scheduling data that schedules the lighting scenes at each time to the gateway 130. At this time, the remote controller 120 can transmit the scheduling data to the gateway 130 via the short range wireless communication.

The remote controller 120 may be operated in a normal mode and a sleep mode, wherein in the normal mode in which scheduling function is activated, the remote controller 120 automatically controls the lighting device 10 according to the scheduling data. In contrast, in the sleep mode in which scheduling function is inactivated, the remote controller 120 is manually operated by a manager to control the lighting device 110.

After receiving the scheduling data from the remote controller 120, the gateway 130 transmits the received scheduling data to the remote server 140.

The gateway 130 confirms whether the remote controller 120 is normally operated and when the remote controller 120 is not normally operated, the gateway 130 transfers an abnormal alarm signal to the remote server 140.

For example, the gateway 130 may periodically transfer an operation confirmation message to the remote controller 120 so as to confirm whether the remote controller 120 is normally operated. At this time, when the remote controller 120 is normally operated, a response message is transmitted in response to the operation confirmation message, and when the remote controller 120 is not normally operated, a response message cannot be transmitted in response to the operation confirmation message. In this case, the gateway 130 generates an abnormal alarm signal and transfers it to the remote server 140.

When the remote controller 120 is not normally operated, the gateway 130 controls the lighting device 110 according to the scheduling control signal transmitted from the remote server 140. At this time, the gateway 130 can control the lighting device 110 via the short range wireless communication.

The remote server 140 receives the scheduling data from the gateway 130 and stores it in a database. In this case, the lighting control scheduling of the lighting device 110 can be managed not only in the remote controller 120 but also in the remote server 140.

When the abnormal alarm signal is transmitted from the gateway 130, the remote server 140 transmits the scheduling control signal that controls the lighting device 110 according to the stored scheduling data to the gateway 130.

In other words, when the power supply of the remote controller 120 is turned-off or the battery thereof is discharged such that it is not normally operated, the remote server 140 transmits the scheduling control signal to the gateway 130 and controls the lighting device 110.

In this case, the lighting device 110 can be controlled according to the scheduling data not only in a short range but also in a long range, wherein the remote controller 120 primarily controls the lighting device 110 in a short range and the remote server 140 secondarily controls the lighting device 110 in a long range when the lighting device 110 is not controlled in a short range.

According to the embodiments of the present invention, the lighting of the lighting devices installed in each separate area within the corresponding building can be automatically controlled at each preset time. At this time, the dimming level, the color temperature level, and the like of the lighting devices installed in each separate area as well as the simple on/off control of the lighting devices can be automatically controlled according to the scheduling data.

The lighting scene is sorted into a mathematics and inquiry learning mode, a creativity learning mode, a memory subject learning mode, a break time/lunch time mode, a self-study mode, and the like, according to class schedules of each classroom, thereby making it possible to obtain optimal learning effects according to the characteristics of the corresponding subjects and reduce energy.

In addition, a short range wireless communication is performed between the remote controller and the lighting device, such that a manager can directly schedule the lighting scenes at each time through the remote controller, while carrying the remote controller.

In addition, the scheduling data set in the remote controller is transmitted to the remote server, such that the scheduling data can be automatically reflected in the remote server. In this case, if the remote controller is not normally operated, the lighting device can be controlled by the remote server according to the scheduling data.

Meanwhile, the present invention has been described in such a manner that the gateway 130 periodically transmits an operation confirmation message to the remote controller 120 to confirm whether the remote controller 120 is normally operated. However, the method for confirming whether the remote controller 120 is normally operated is not limited thereto but various other methods may be used.

For example, the remote controller 120 may measure its battery voltage level state and then periodically transmit the battery voltage level data to the gateway 130. At this time, the remote controller 120 may measure the voltage level of the battery using a reference voltage based on Zener Diode.

In addition, the lighting control system 100 may further include an illumination sensor, a motion sensor, and the like, wherein the illumination sensor and the motion sensor may be installed in each separate area within the corresponding building. The illumination sensor and the motion sensor may be integrated into one sensor module, wherein the sensor module may be configured to perform a short range wireless communication among the lighting device 110, the remote controller 120 and the gateway 130.

For example, the sensor module can transmit illumination information on the corresponding separate area measured by the illumination sensor and motion information on the corresponding separate area measured by the motion sensor to at least one of the lighting device 110, the remote controller 120, and the gateway 130.

Herein, the short range wireless data communication among the lighting device 110, the remote controller 120, the gateway 130, and the sensor module (not shown) of the lighting control system 100 may be performed through the frame formats shown in the following Table 1.

TABLE 1

| | STX | DataLen | Data | CheckSum | ETX |
|---|---|---|---|---|---|
| Value | | | | | |

Herein, STX (Start of Text) represents the start of a frame, DataLen represents the length of data, and Data represents the contents to be transmitted through the corresponding frame. CheckSum represents the confirmation whether an error of Data occurs, and ETX (End of Text) represents the end of the frame. At this time, the Data format of frame formats shown in Table 1 may be represented by the following Table 2.

TABLE 2

| | Primitive | Device Address | Command | Command Data |
|---|---|---|---|---|
| Value | | | | |

Herein, Primitive represents the object of transmitting Data, Device Address represents the address (that is, unique identification information) of a device to transmit Data, Command represents the command to be given to the corresponding device, and Command Data represents the contents of the corresponding Command.

The devices included in the lighting control system 100 (for example, the lighting device, the remote controller, the gateway, and the like) have unique device addresses so as to identify each device in the short range wireless communication. At this time, the devices may be sorted according to the device type.

Figure 2:
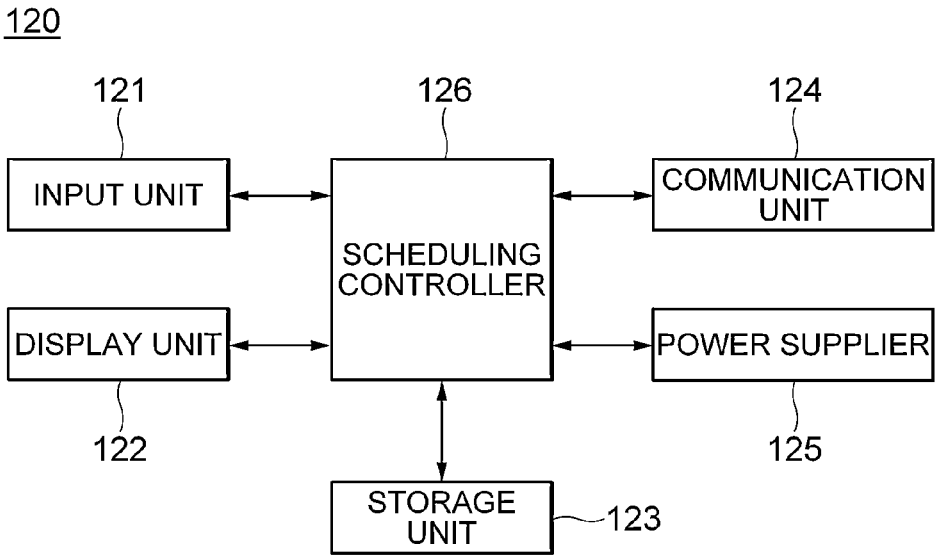
FIG. 2 is a diagram showing a constitution of a remote controller according to an embodiment of the present invention.

FIG. 2 is a diagram showing a constitution of a remote controller according to an embodiment of the present invention.

Referring to FIG. 2, the remote controller 120 is configured to include an input unit 121, a display unit 122, a storage unit 123, a communication unit 124, a power supplier 125, and a scheduling controller 126.

The input unit 121 receives a manager's command for scheduling lighting scenes per time for each separate area in which the lighting device 110 is installed and transfers it to the scheduling controller 126. For example, the input unit 121 receives the command of a manager who selects a predetermined class schedule from class schedules of each classroom and receives the command of a manager who selects the lighting scene for the corresponding subject of the class schedule.

The display unit 122 displays a screen for scheduling the lighting scenes at each time. For example, the display unit 122 displays class schedules of each classroom on a screen and displays a screen for selecting a lighting scene of the corresponding subject according to the class schedule. Herein, the input unit 121 and the display unit 122 may be configured of one liquid crystal display (LCD) touch screen.

The storage unit 123 stores unique identification information (for example, address information and the like) of the lighting devices 110 installed within the corresponding building.

The storage unit 123 stores on/off information, dimming level information, and color temperature information according to each lighting scene. For example, the lighting scene may be sorted into a mathematics and inquiry learning mode, a creativity learning mode, a memory subject learning mode, a break time/lunch time mode, a self-study mode, and the like according to the class schedule. At this time, the storage unit 123 stores the on/off information, the dimming level information, the color temperature information, and the like corresponding to each lighting scene.

In addition, the storage unit 123 stores scheduling data set by the manager for each lighting device 110.

The communication unit 124 transfers the scheduling data that schedules the lighting scenes at each time through the control of the scheduling controller 126 to the gateway 130.

The communication unit 124 transmits scheduling control signals to each lighting device 110 according to the control of the scheduling controller 126. The scheduling control signal includes unique identification information on the corresponding lighting device 110 and information on the lighting scene that is implemented by the corresponding lighting device 110 (for example, on/off information, dimming level information, color temperature information, and the like).

Further, the communication unit 124 transmits a response message in response to an operation confirmation message that is periodically transmitted from the gateway 130.

As the communication unit 124, a short range wireless communication unit, such as, Zigbee, Blue Tooth, Wireless Local Area Network (WLAN), Ultra Wide Band (UWB), Home RF, Infrared Data Association (IrDA), and the like, may be used.

The power supplier 125 supplies power to the respective constituents. As the power supplier 125, a battery may be used.

The scheduling controller 126 controls the respective constituents. For example, the scheduling controller 126 controls the display unit 122 so as to display a screen that schedules the lighting scenes at each time.

The scheduling controller 126 schedules the lighting scenes at each time according to the manager's command input by the input unit 121 and then, stores the scheduling data in the storage unit 123. The scheduling controller 126 controls the communication unit 124 so as to transmit the scheduling data to the gateway 130.

When it comes to the corresponding class, the scheduling controller 126 generates a scheduling control signal according to the scheduling data and controls the communication unit 124 so as to transmit the scheduling control signal to the lighting device 110.

More specifically, when the start time of each class schedule confirmed by confirming the time through a timer, the scheduling controller 126 generates a scheduling control signal so that the lighting scene set in the corresponding class according to the scheduling data of the corresponding class schedule is implemented. The scheduling control signal includes unique identification information on the corresponding lighting device 110 and information on the lighting scene that is implemented by the corresponding lighting device 110. Thereafter, the scheduling controller 126 transmits the scheduling control signal to the corresponding lighting device 110 through the communication unit 124.

When the operation confirmation message is transmitted from the gateway 130, the scheduling controller 126 controls the communication unit 124 so as to transmit a response message in response to the operation confirmation message.

Figure 3:
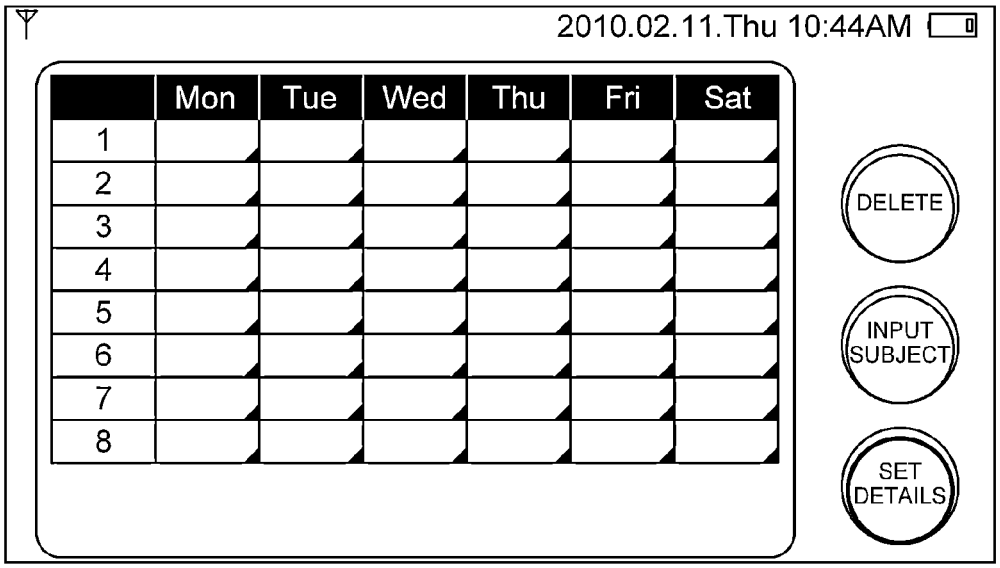
FIG. 3 is a diagram showing a class schedule screen of a remote controller according to an embodiment of the present invention.
Figure 4:
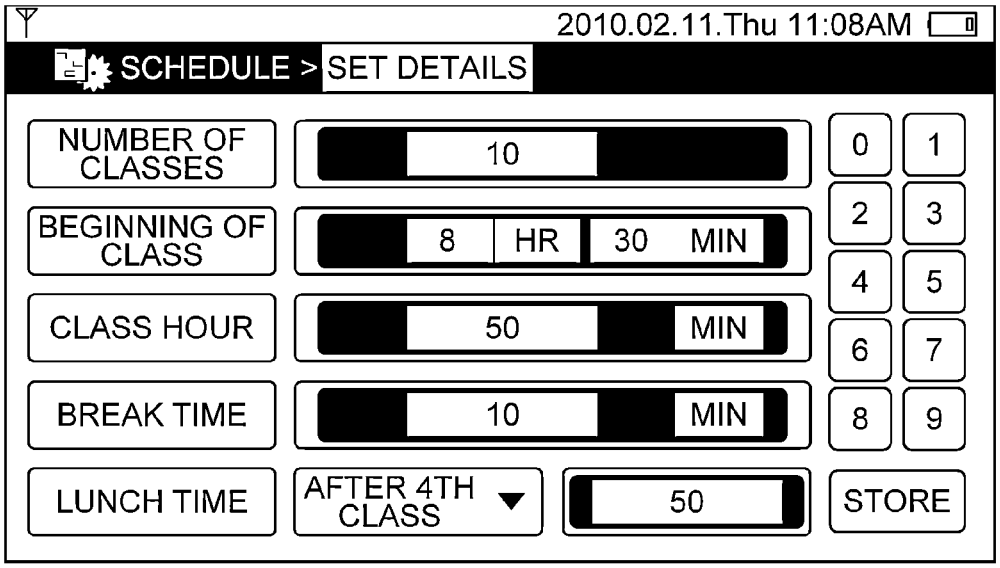
FIG. 4 is a diagram showing a screen for setting details of a class schedule on a remote controller according to an embodiment of the present invention.
Figure 5:
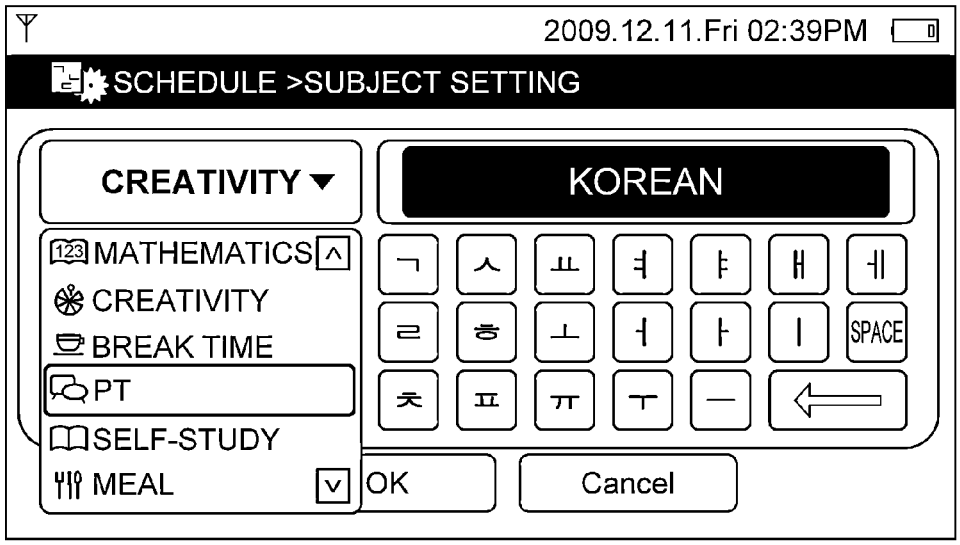
FIG. 5 is a diagram showing a screen for selecting a lighting scene of a remote controller according to an embodiment of the present invention.

FIG. 3 is a diagram showing a class schedule screen of a remote controller according to an embodiment of the present invention, FIG. 4 is a diagram showing a screen for setting details of a class schedule on a remote controller according to an embodiment of the present invention, and FIG. 5 is a diagram showing a screen for selecting a lighting scene of a remote controller according to an embodiment of the present invention.

First, referring to FIG. 3, a schedule may be constituted by inputting the subjects into the corresponding classes for each day. For example, on Monday, the schedule may be constituted, for example: 1st class—Korean; 2nd class—English; 3rd class—Mathematics; 4th class—Music; 5th class—Art; 6th class—Physics, and the like. At this time, referring to FIG. 4, the schedule may be constituted by setting, in detail, beginning of class, class hour, break time, and the like for each subject.

Then, referring to FIG. 5, when selecting the subject of the predetermined schedule, after constituting the schedule by inputting the subjects into the corresponding classes for each day, a screen capable of setting the lighting scene in the subject of the corresponding schedule is shown.

The lighting scene may be sorted into various modes, such as, Mathematics, Creativity, Break time, PT, Self-study, Meal, and the like, and the manager can select a lighting scene matching the characteristics of the corresponding subject. Herein, the case in which the lighting scene is preset has been described by way of example. However, the present invention is not limited thereto but may be implemented so that the manager directly sets the lighting scene to be used in the corresponding subject for each subject.

Figure 6:
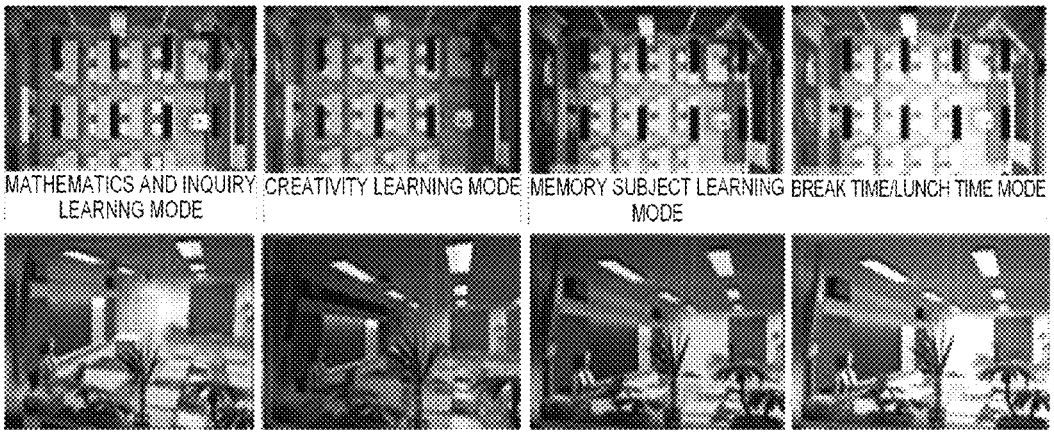
FIG. 6 is a diagram showing a state in which lighting scene are implemented by lighting devices according to an embodiment of the present invention.

FIG. 6 is a diagram showing a state in which lighting scenes are implemented by lighting devices according to an embodiment of the present invention.

Referring to FIG. 6, the dimming level or the color temperature level of the respective lighting scenes is implemented to be different according to, for example, a mathematic and inquiry learning mode, a creativity learning mode, a memory subject learning mode, a break time/lunch time mode, and the like.

For example, in the mathematics and inquiry learning mode, the color temperature is set to be in a range from 4000K to 6500K, in the creative learning mode, the color temperature is set to be in a range from 2500K to 3000K, and in the memory subject learning mode, the color temperature is set to be in a range from 3500K to 4000K. This shows that the color temperature is set in order that the optimal learning effects according to the characteristics of each subject are obtained. At this time, the lighting devices may be controlled to be different per zones in the corresponding separate area.

In the break time/lunch time mode, the dimming level may be set to be a fifth level or less out of a total of seven levels, wherein reducing energy can be achieved.

Figure 7:
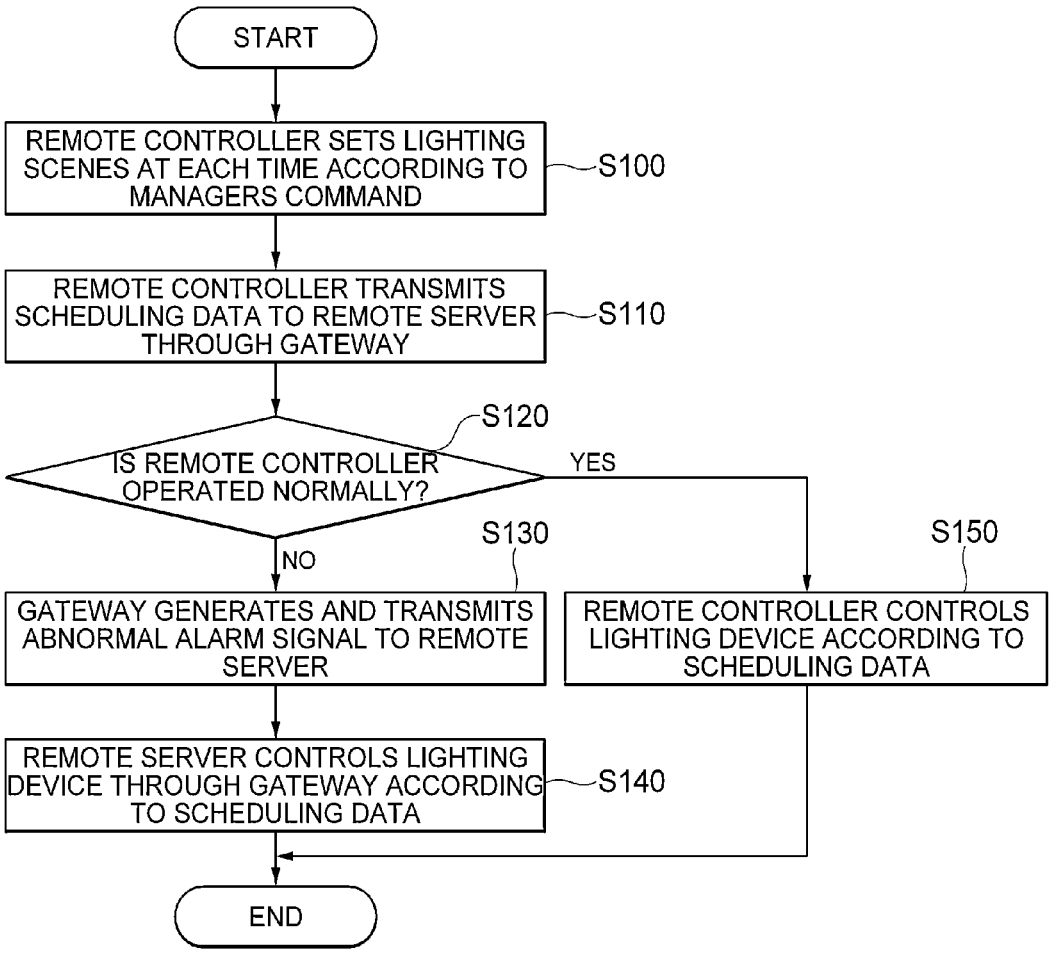
FIG. 7 is a flowchart showing a lighting control method according to an embodiment of the present invention.

FIG. 7 is a flowchart showing a lighting control method according to an embodiment of the present invention.

Referring to FIG. 7, a remote controller 120 sets lighting scenes per time in each separate area in which a lighting device 110 is installed according to a manager's command (S100). At this time, the remote controller 120 generates a scheduling data by setting the lighting scenes.

The remote controller 120 transmits the scheduling data that sets the lighting scenes at each time to a remote server 140 through a gateway 130 (S110). At this time, the remote server 140 stores the received scheduling data in a database.

The gateway 130 confirms whether the remote controller 120 is normally operated (S120) and when the remote controller 120 is not normally operated, the gateway 130 generates and transfers an abnormal alarm signal to the remote server 140 (S130).

When the abnormal alarm signal is transmitted from the gateway 130, the remote server 140 controls the lighting device 110 according to the scheduling data through the gateway 130 (S140).

Meanwhile, when the remote controller 120 is normally operated in step S120, the remote controller 120 controls the lighting device 110 according to the scheduling data (S150).

According to the exemplary embodiments of the present invention, the lighting of the lighting devices installed in each separate area within the corresponding building can be automatically controlled according to the scheduling data. At this time, the dimming level, the color temperature level, and the like of the lighting devices installed in each separate area as well as the simple on/off control of the lighting devices can be automatically controlled according to the scheduling data.

In addition, the short range wireless communication is performed between the remote controller and the lighting device, such that the manager can directly schedule the lighting scenes at each time through the remote controller, while carrying the remote controller.

In addition, the scheduling data set in the remote controller is transmitted to the remote server, such that the scheduling data can be automatically reflected in the remote server. In this case, if the remote controller is not normally operated, the lighting device can be controlled by the remote server according to the scheduling data.

Further, when the lighting control system is used for a school, the lighting scene is sorted into a mathematics and inquiry learning mode, a creativity learning mode, a memory subject learning mode, break time/lunch time mode, a selfstudy mode, and the like according to the class schedules of each classroom, thereby making it possible to obtain optimal learning effects according to the characteristics of the corresponding subjects and reduce energy.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

Accordingly, such modifications, additions and substitutions should also be understood to fall within the scope of the appended claims and their equivalents.

What is claimed is:

1. A lighting control system, comprising:

lighting devices that are installed in separate areas within a building;

a remote controller that generates scheduling data by setting lighting scenes configured to be implemented by the lighting devices at scheduled times, transmits the scheduling data to the outside, and controls the lighting devices according to the scheduling data;

a remote server that receives the scheduling data from a gateway and stores the scheduling data; and the gateway that receives the scheduling data from the remote controller and transmits the scheduling data to the remote server.

2. The lighting control system according to claim 1, wherein the gateway confirms whether the remote controller is normally operated, and in response to the gateway confirming that the remote controller is not normally operated, the gateway generates an abnormal alarm signal and transmits the abnormal alarm signal to the remote server.

3. The lighting control system according to claim 2, wherein the gateway periodically transmits an operation confirmation message to the remote controller.

4. The lighting control system according to claim 2, wherein in response to receiving the abnormal alarm signal, the remote server controls the lighting devices according to the stored scheduling data through the gateway.

5. The lighting control system according to claim 4, wherein the lighting devices, the remote controller, and the gateway perform a short range wireless communication therebetween.

6. The lighting control system according to claim 1, wherein the remote controller generates a scheduling control signal according to the scheduling data and transmits the scheduling control signal to the lighting devices, and the scheduling control signal includes unique identification information on the corresponding lighting devices and at least one of on/off control signal, dimming level control signal, and color temperature control signal of the corresponding lighting devices.

7. The lighting control system according to claim 1, wherein the lighting devices are configured to be installed in classrooms of a school, and the lighting scenes include a mathematics and inquiry learning mode, a creativity learning mode, a memory subject learning mode, a breaktime/lunch time mode, and a selfstudy mode according to a corresponding class schedule.

8. A lighting control system, comprising:

lighting devices that are installed in separate areas within a building; and a remote controller that generates scheduling data by setting lighting scenes configured to be implemented by the lighting devices at scheduled times and selectively controls, according to an operational status of the remote controller, the lighting devices according to the scheduling data, wherein one of the remote controller and a remote server which stores the scheduling data controls the lighting devices according to the scheduling data, according to the operational status of the remote controller.

9. The lighting control system according to claim 8, wherein the lighting devices and the remote controller perform a short range wireless communication.

10. The lighting control system according to claim 8, wherein the remote controller generates a scheduling control signal according to the scheduling data and transmits the scheduling control signal to the lighting devices, and the scheduling control signal includes unique identification information on the corresponding lighting devices and at least one of on/off control signal, dimming level control signal, and color temperature control signal of the corresponding lighting devices.

11. The lighting control system according to claim 8, wherein the lighting devices are installed in classrooms within a school, and the lighting scenes include a mathematics and inquiry learning mode, a creativity learning mode, a memory subject learning mode, a break time/lunch time mode, and a self-study mode according to a corresponding class schedule.

12. The lighting control system according to claim 8, wherein, if the operational status of the remote controller indicates that the remote controller is normally operated, the remote controller controls the lighting devices according to the scheduling data, and if the operational status of the remote controller indicates that the remote controller is not normally operated, the remote server controls the lighting devices according to the scheduling data.

13. The lighting control system according to claim 8, wherein the operational status comprises a battery power level of the remote controller.

14. The lighting control system according to claim 8, wherein the operational status comprises whether the remote controller is turned on or off.

15. A lighting control method, comprising:

(A) generating, by a remote controller, scheduling data by setting lighting scenes at scheduled times in separate areas within a building in which lighting devices configured to implement the lighting scenes are installed according to a command;

(B) transmitting, by the remote controller, the scheduling data to a remote server through a gateway; and (B-1) controlling, by one of the remote controller and the remote server, the lighting devices according to the scheduling data, according to whether the remote controller is normally operated.

16. The lighting control method according to claim 15, wherein the operation (B-1) comprises the operations of:

(C) confirming, by the gateway, whether the remote controller is normally operated;

(D) in response to confirming that the remote controller is not normally operated, generating, by the gateway, an abnormal alarm signal and transmitting, by the gateway, the abnormal alarm signal to the remote server; and (E) controlling, by the remote server, the lighting devices according to the scheduling data through the gateway.

17. The lighting control method according to claim 16, wherein the operation (B-1) further comprises the operation of:

(C-1) controlling, by the remote controller, the lighting devices according to the scheduling data in response to confirming the remote controller is normally operated in operation (C).

* * * * *